US011707406B1

(12) United States Patent
Jumili

(10) Patent No.: US 11,707,406 B1
(45) Date of Patent: Jul. 25, 2023

(54) MASSAGING BOOT

(71) Applicant: Noelle Jumili, Jacksonville, FL (US)

(72) Inventor: Noelle Jumili, Jacksonville, FL (US)

( * ) Notice: Subject to any disclaimer, the term of this patent is extended or adjusted under 35 U.S.C. 154(b) by 470 days.

(21) Appl. No.: 17/008,854

(22) Filed: Sep. 1, 2020

(51) Int. Cl.
*A61H 35/00* (2006.01)
*A61H 9/00* (2006.01)
*A41B 11/00* (2006.01)

(52) U.S. Cl.
CPC ..... *A61H 35/006* (2013.01); *A41B 11/00* (2013.01); *A61H 9/0021* (2013.01); *A61H 2009/0042* (2013.01); *A61H 2201/0207* (2013.01); *A61H 2201/164* (2013.01); *A61H 2201/165* (2013.01); *A61H 2201/5097* (2013.01)

(58) Field of Classification Search
CPC .. A61H 35/006; A61H 9/0021; A61H 9/0042; A61H 2201/0207; A61H 2201/164; A61H 2201/165; A61H 2201/5097; A61H 2201/1654; A61H 33/00; A61H 35/00; A61H 35/002; A41B 11/00
See application file for complete search history.

(56) References Cited

U.S. PATENT DOCUMENTS 3,478,738 A * 11/1969 Cox ..... A43B 7/02 36/2.6
4,149,529 A * 4/1979 Copeland ..... A61H 9/0078 607/104
4,989,589 A 2/1991 Pekanmaki
6,027,464 A * 2/2000 Dahlquist ..... A61H 1/0229 601/151
7,328,476 B1 * 2/2008 Heidemeyer, Jr. ... A61H 35/006 601/114
9,308,388 B2 * 4/2016 Chau ..... A61N 5/0613
10,959,483 B1 * 3/2021 Baichu ..... A43B 7/12
11,559,460 B2 * 1/2023 Chiu ..... A61H 9/0078
2002/0017358 A1 * 2/2002 Williams ..... A41D 19/0006 156/156
2005/0015874 A1 * 1/2005 Watanabe ..... A61H 33/6089 4/622

(Continued)

FOREIGN PATENT DOCUMENTS

WO WO-02074223 A1 * 9/2002 ..... A61H 33/6057
WO WO-2004071373 A1 * 8/2004 ..... A61H 35/006

(Continued)

*Primary Examiner* — Philip R Wiest
*Assistant Examiner* — Tyler A Raubenstraw
(74) *Attorney, Agent, or Firm* — Sanchelima & Associates, P.A.; Christian Sanchelima; Jesus Sanchelima

(57) ABSTRACT

A massaging system including a boot assembly, a sock assembly, a hydrotherapy assembly and a remote assembly is disclosed. The boot assembly includes a boot with a reservoir for water that is filled through a valve and sealed with a valve cap. Within the boot is a cavity to suspend a sock of the sock assembly within. Along the perimeter of the cavity are jet nozzles to spray water from the reservoir to the sock to provide hydrotherapy to a foot of a user received within the sock. Openings are also located about the perimeter of the cavity allowing water to be returned to the reservoir for continued use. The hydrotherapy assembly includes a water pump and a water heater that cooperate with the jet nozzles to control the settings thereof. The user is able to control the jet nozzles with a remote to customize the hydrotherapy received.

12 Claims, 3 Drawing Sheets

(56) References Cited

U.S. PATENT DOCUMENTS

| | | | | |
|---|---|---|---|---|
| 2005/0277854 | A1* | 12/2005 | Hatchett | A61H 35/006 601/158 |
| 2006/0189905 | A1* | 8/2006 | Eischen | A61H 9/0085 601/151 |
| 2007/0131798 | A1* | 6/2007 | Katsukawa | A61H 33/005 239/455 |
| 2013/0211296 | A1* | 8/2013 | Chau | A61H 35/006 601/17 |
| 2016/0051400 | A1* | 2/2016 | Ruetenik | A61F 7/103 601/15 |
| 2019/0099321 | A1* | 4/2019 | Elderstiern | A61H 9/0007 |
| 2020/0037700 | A1* | 2/2020 | Naiker | A43B 17/02 |
| 2020/0147407 | A1* | 5/2020 | Efremkin | A61K 31/5375 |
| 2020/0337385 | A1* | 10/2020 | Scott | A41B 11/10 |

FOREIGN PATENT DOCUMENTS

| | | | | |
|---|---|---|---|---|
| WO | WO-2018052676 | A1 * | 3/2018 | A61F 13/08 |
| WO | WO-2020160823 | A1 * | 8/2020 | A61H 33/0087 |

* cited by examiner

MASSAGING BOOT

BACKGROUND OF THE INVENTION

1. Field of the Invention

The present invention relates to a massaging boot and, more particularly, to a massaging boot that can provide hydrotherapy to a user to reduce swelling to the feet of the user.

2. Description of the Related Art

Several designs for massaging boots have been designed in the past. None of them, however, include a massaging hydrotherapy boot having multiple integral jet nozzles, insulated walls, a heating system, and a wireless remote control.

Applicant believes that a related reference corresponds to U.S. Pat. No. 9,308,388 for ceramic footbath boots. Applicant believes that another related reference refers to U.S. Pat. No. 4,989,589 for a device for massaging extremities, such as legs. None of these references, however, teach of a massaging boot that can be elevated during usage to expedite the reduction in swelling in the feet of the user by allowing the user to elevate their feet above their heart while laying down and receiving hydrotherapy.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a massaging boot that helps to reduce swelling of the feet.

It is another object of this invention to provide a massaging boot that can be elevated above heart level during usage.

It is still another object of the present invention to provide a massaging boot that can be customized for various settings to provide comfort to the liking of the user.

It is also another object of the present invention to provide a massaging boot that can provide hydrotherapy to the user for increased comfort and health benefits.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
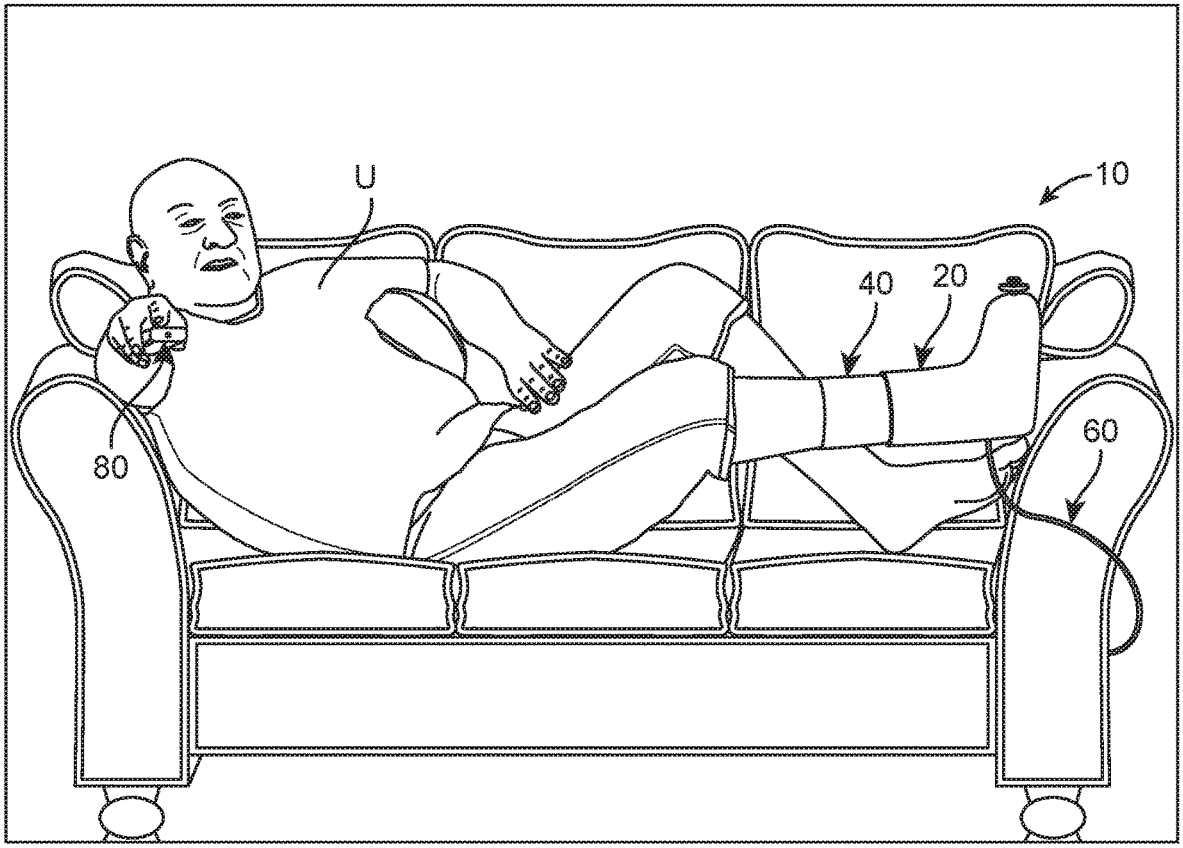
FIG. 1 represents an operational view showing a user U wearing massaging system 10 while laying down.

Referring now to the drawings, where the present invention is generally referred to with numeral 10, it can be observed that a massaging system 10 basically includes a boot assembly 20, a sock assembly 40, a hydrotherapy assembly 60 and a remote assembly 80.

Massaging system 10, as best seen in FIGS. 1-4, can be used to provide a user U with hydrotherapy. The hydrotherapy may help to alleviate discomfort and swelling to user U, more specifically, to the feet of user U. Importantly, as best depicted in FIG. 1, massaging system 10 may be elevated above the heart level of user U to allow for more rapid relief of swelling to the feet of user U. Massaging system 10 helps to provide health improvements while also providing relaxation to user U.

Figure 2:
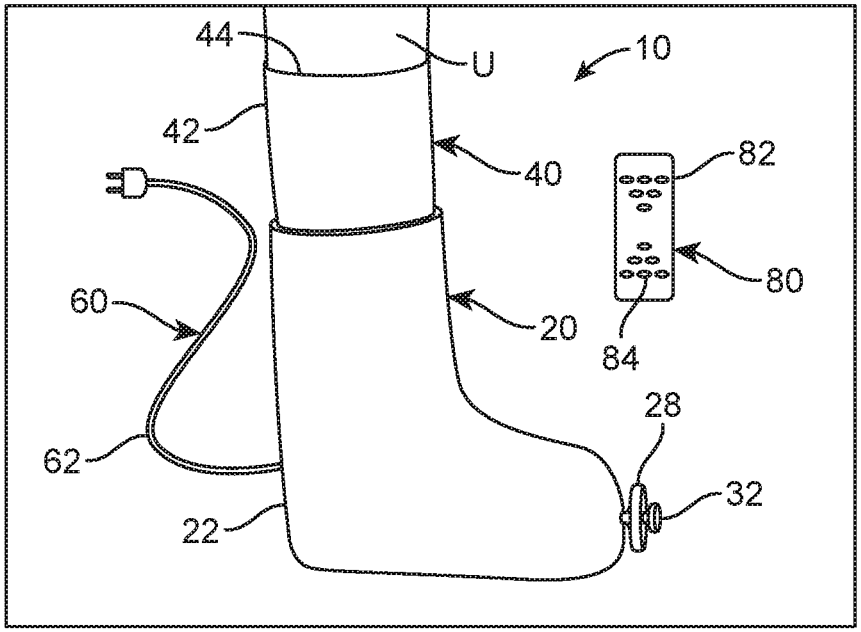
FIG. 2 shows an isometric view of boot 22.
Figure 3:
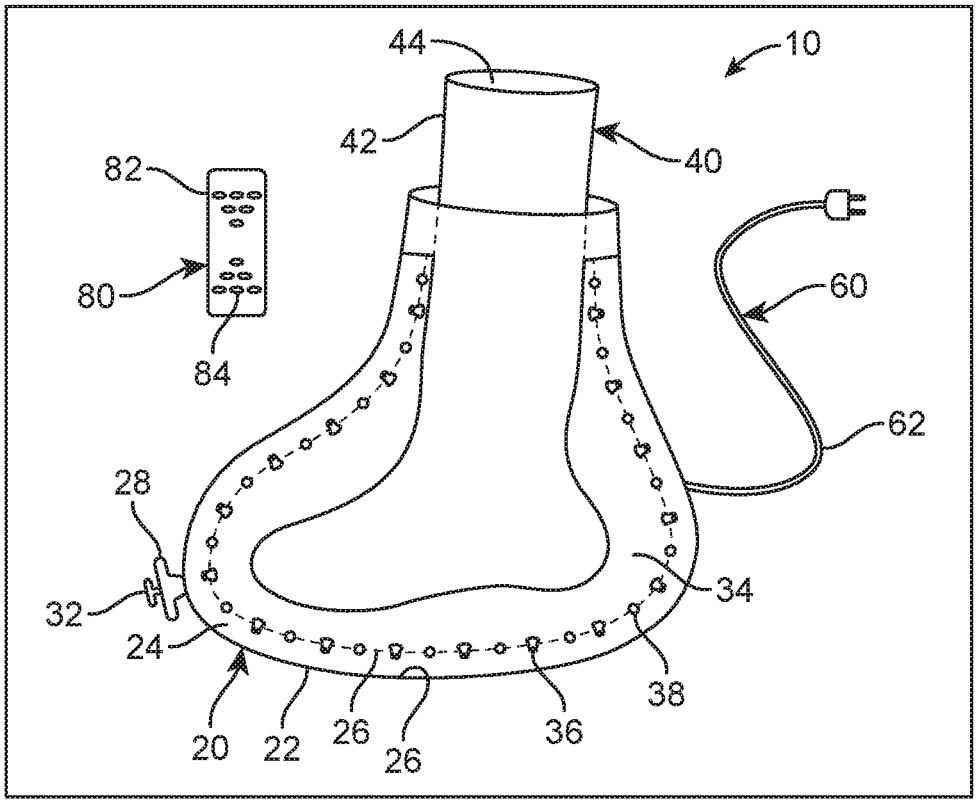
FIG. 3 illustrates a see-through view of boot 22.

Massaging system 10 may include boot assembly 20, as best seen in FIGS. 2-3. Boot assembly 20 may provide the hydrotherapy to user U. Boot assembly 20 may include boot 22. Boot 22 may have a substantial boot-shaped configuration that extends upwardly along the calf of user U. Boot 22 may suitably be made of materials such as plastic, rubber, aluminum, wood or the like. The exterior of boot 22 may be substantially smooth, in one embodiment. Preferably, boot 22 may be lightweight allowing for user U to elevate their feet while wearing boot 22. It is to be understood that boot 22 may be sealed from a top end.

Within boot 22 may be a reservoir 24, as best seen in FIG. 3, that may be used to contain water necessary for the hydrotherapy provided by massaging system 10. Reservoir 24 may extend partially along the perimeter of boot 22. Water may flow freely within reservoir 24. Reservoir may be lined with insulated walls 26. Insulated walls 26 may be defined as the top wall and bottom wall of reservoir 24. Insulated walls 26 may help to maintain the temperature of water within reservoir 24 as desired by user U. Water may be kept warm or cold with insulated walls 26 as needed.

Reservoir 24 may be filled or drained through valve 28. Valve 28 may lead to an interior of reservoir 24, as best seen in FIG. 3. Valve 28 may protrude outwardly and away from boot 22 and more specifically from reservoir 24. Valve 28 may be tapered, in one embodiment. Valve 28 may be selectively sealed with a valve cap 32 to help maintain water within water reservoir 24. Valve cap 32 may extend outwardly and away from valve 28. Valve cap 32 may be removed when there is a need to fill or drain reservoir 24.

Importantly, as best illustrated in FIG. 3, boot 22 may have a cavity 34 within. Cavity 34 may be substantially hollow to receive sock assembly 40 and the foot of user U to be treated with hydrotherapy by massaging system 10. Cavity 34 may have a similar irregular shape of boot 22. It is to be understood that reservoir 24 may extend the entire perimeter of cavity 34. Additionally, reservoir 24 may be in constant abutting contact with cavity 34. It is to be understood that the same of insulated walls 26 that lines the top of reservoir 24 lines cavity 34 as well. Allowing for water dispensed within cavity 34 to remain at the desired comfortable temperature.

Extending about the perimeter of cavity 34 may be jet nozzles 36 and openings 38. Jet nozzles 36 and openings 38 may be evenly spaced apart along the perimeter cavity 34. It may be suitable for jet nozzles 36 and openings 38 to be arrange in an alternating configuration, as best shown in FIG. 3. In one embodiment, jet nozzles 36 may integral and protrude into cavity 34. Jet nozzles 36 may alternatively be referred to as integral jet nozzles. Jet nozzles 36 may spray water from water reservoir 24 into cavity 34 to help provide the hydrotherapy to the foot of user U. Jet nozzles 36 may spray the water into cavity 34 at a predetermined pressure as desired by user U. It is to be understood that the pressure at which jet nozzles 36 dispense water may be customizable and controlled by user U with remote assembly 80. Water may be dispensed in numerous directions into cavity 34 with jet nozzles 36. Openings 38 may be adapted to allow for water that is sprayed into cavity 34 to be released back into reservoir 24 to allow for recycled use of the water for continuous hydrotherapy to be provide to user U. Openings 38 may be unidirectional. Thereby meaning that water may escape from cavity 34 through openings 38. However, water may not enter or seep into cavity 34 through openings 38.

It is to be understood that sock assembly 40 may be received within boot assembly 20. Sock assembly 40 may include a sock 42. It is to be understood that sock 42 may receive the foot of user U that is to receive hydrotherapy through a sock opening 44 at a top portion of sock 42. Sock 42 may be received and suspended within cavity 34. The foot of the user is suspended within cavity 34 with sock 42. Allowing for sock 42 to be sprayed by water from jet nozzles 36 from multiple directions. Preferably, sock 42 may be made of a waterproof material such as neoprene, to help keep the foot of user U dry even as hydrotherapy is administered. Sock 42 may be thin enough to allow for the temperature of the water sprayed to be felt by user U during the hydrotherapy. Sock 42 may have a shape that cooperates with cavity 34 and the foot of user U. Sock 42 may be flexible and expandable to accommodate different sized feet of different users. Boot 22 may include a sock opening at a top end that is to receive sock 42 therethrough. Sock 42 may entirely seal the sock opening. It is to be understood that sock 42 may partial protrude outwardly from boot 22.

For providing relief to the foot of user U hydrotherapy assembly 60 may be used. Hydrotherapy assembly 60 may help user U reduce swelling to their foot leading to improved health. Hydrotherapy assembly 60 may include a power cord 62, a processor 64 and a wireless communication module 66. Power cord 62 may be connected to a power source S for providing power to processor 64 and jet nozzles 36. Wireless communication module 66 may be connected to and powered by processor 64. Wireless communication module 66 may be capable of communication through WIFI, Bluetooth, radio broadcast (RF), infrared (IR), or microwave means. Wireless communication module 66 may allow for wireless communication to occur between hydrotherapy assembly 60 and remote assembly 80 for controlling of the setting of boot 22 during hydrotherapy.

Figure 4:
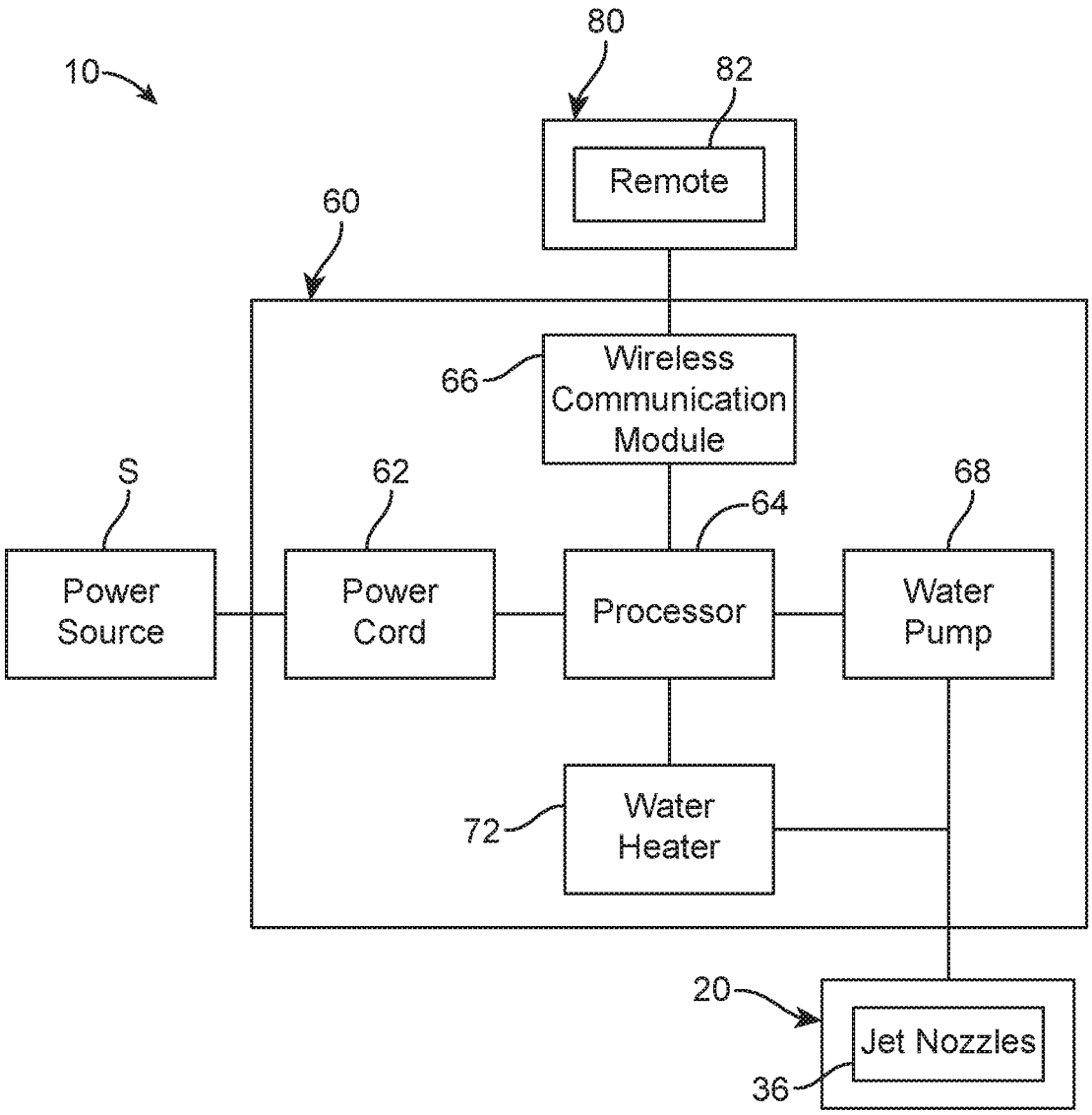
FIG. 4 is a representation of a chart showing hydrotherapy assembly 60.

Importantly, hydrotherapy assembly 60 may include a water pump 68 and a water heater 72. As best seen in FIG. 4, water pump 68 and water heater 72 may be interconnected to and cooperate with jet nozzles 36. Water pump 68 may cooperate with jet nozzles 36 to control the pressure at which the water from reservoir 24 is sprayed at sock 42 during usage of the present invention. Water heater 72 may help to heat the water within reservoir 24. Thereby, allowing for water sprayed by jet nozzles 36 to be warmed before being sprayed for added comfort and relief to user U.

User U may be able to control the strength of the water pressure being used during the hydrotherapy. User U may also be able to control the temperature of the water used during the hydrotherapy. Remote assembly 80 may permit user U to have such control during the hydrotherapy being administered. Remote assembly 80 may include a remote 82 that is preferably wireless. Remote 82 may cooperate with wireless communication module 66 for wireless control of water pump 68 and water heater 72. Remote 82 may have controls 84 for controlling the setting for water pump 68 and water heater 72. Some of controls 84 may correspond with the settings of water pump 68. Additional of controls 84 may correspond with the settings of water heater 72. Controls 84 may be of different lengths. It may be suitable for controls 84 to extend horizontally across remote 82. Controls 84 may also be evenly spaced apart and parallel to each other. It is to be understood that controls 84 may alternatively be referred to as buttons or switches.

Massaging system 10 assists users in receiving hydrotherapy to alleviate swelling or discomfort, more particularly to the feet of users. Importantly, with massaging system 10 users are able to elevate their feet above of heart level while laying down to further expedite the process of reducing swelling. The foot of user U needing hydrotherapy is received within sock 42. Sock 42 is secured within boot 22. Wherein hydrotherapy can be provided to user U with jet nozzles 36. Thereby helping user U to receive relief and comfort which may lead to health improvements.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A massaging system, comprising:

a) a boot assembly including a boot, said boot including a reservoir extending about a perimeter thereof, said reservoir adapted to receive water within, said reservoir lined with insulated walls adapted to regulate and maintain a desired temperature of said water, said boot further including a cavity, said cavity having integral jet nozzles extending about a cavity perimeter, wherein openings also extend about said cavity perimeter, said openings being in between said integral jet nozzles, wherein said openings and said jet nozzles are evenly spaced apart, wherein said opening lead said water sprayed by said integral jet nozzles out from said cavity and back into said reservoir, wherein said openings are unidirectional, wherein said reservoir extends about said cavity perimeter, said reservoir and said cavity being in constant abutting contact with each other;

b) a sock assembly including a sock, said sock received and suspended within said cavity, a foot of a user received within said sock, said jet nozzles spraying said water from said reservoir towards said sock adapted to provide a massage and relief to said foot within said sock;

c) a hydrotherapy assembly including a water heater, said water heater raising said desired temperature of said water sprayed by said integral jet nozzles; and d) a remote assembly including a remote to control heat settings and pressure settings of said water and said integral jet nozzles when said massage is administered.

2. The system of claim 1, wherein said reservoir is fillable through a valve, said valve extending outwardly and away from said boot, said valve being tapered.

3. The system of claim 2, wherein said valve is selectively sealed with a valve cap, said valve cap protruding outwardly and away from said valve.

4. The system of claim 1, wherein said sock include a sock opening leading to an interior of said sock, said sock opening being at a top distal end of said sock.

5. The system of claim 1, wherein said sock is fixedly secured within said boot, said sock being partially visible, said sock extending outwardly and away from said boot.

6. The system of claim 1, wherein said integral jet nozzles partially protrude into said cavity.

7. The system of claim 1, wherein said sock is waterproof.

8. The system of claim 1, wherein said hydrotherapy assembly further includes a power cord, a processor, a wireless communication module and a water pump.

9. The system of claim 8, wherein said power cord is attached to said boot at a distal end and adapted to be attached to a power source at an opposite distal end to provide power to said hydrotherapy assembly.

10. The system of claim 8, wherein said water pump controls the pressure settings for the water to be sprayed by the integral water nozzles.

11. The system of claim 8, wherein said wireless communication module is connected to said processor to control the water pump and the water heater thereby controlling the pressure settings and heat settings, respectively, of said water wirelessly with said remote.

12. The system of claim 11, wherein said remote includes controls to adjust the pressure settings and the heat settings as desired by the user, said controls increasing or decreasing the pressure settings and heat settings.

* * * * *